United States Patent [19]

Del Castillo

[11] 4,030,400

[45] June 21, 1977

[54] CHORD PLAYING ATTACHMENT FOR A STRINGED INSTRUMENT

[76] Inventor: Juan M. Del Castillo, Risco No. 119, Mexico City, Mexico, 20 D.F.

[22] Filed: Aug. 19, 1975

[21] Appl. No.: 605,874

[52] U.S. Cl. ..... 84/317

[51] Int. Cl.[2] ..... G10D 3/00

[58] Field of Search ..... 84/317, 318

[56] References Cited

UNITED STATES PATENTS

| | | | |
|---|---|---|---|
| 2,132,281 | 10/1938 | Adamson | 84/317 |
| 2,669,151 | 2/1954 | Maccaferri | 84/317 |
| 2,798,398 | 7/1957 | Hayes | 84/317 |
| 3,682,036 | 8/1972 | Null et al. | 84/317 |
| 3,776,088 | 12/1973 | Jones | 84/317 |
| 3,805,664 | 4/1974 | Starns | 84/317 |

FOREIGN PATENTS OR APPLICATIONS

| | | | |
|---|---|---|---|
| 2,035,909 | 3/1972 | Germany | 84/317 |

*Primary Examiner*—Stephen J. Tomsky
*Attorney, Agent, or Firm*—Karl W. Flocks

[57] ABSTRACT

Apparatus for exerting pressure on several strings of a stringed instrument simultaneously by operation of a pushbutton which transmits either hydraulically or pneumatically or by flexible cable the touch from a single finger, hence a single pushbutton, to several strings of a stringed instrument for such purposes as the playing of a chord.

6 Claims, 4 Drawing Figures

CHORD PLAYING ATTACHMENT FOR A STRINGED INSTRUMENT

BACKGROUND OF THE INVENTION

The present invention is related to an apparatus that simplifies the playing of a stringed instrument, especially an instrument as the guitar and more particularly the touch as applied to several strings simultaneously on such a stringed instrument. At present, the study of stringed instruments, especially the guitar has been rendered difficult because the fingers must have the agility and strength in order to carry out the manipulation of touching different parts forming the guitar simultaneously. To obtain the different harmonies of the notes of the musical scale it is necessary at times to place the fingers in difficult positions and to press with sufficient force on the strings of the guitar in order to obtain sound of the harmony of the desired notes. This in itself makes the playing of such instruments difficult and may discourage the students.

SUMMARY OF THE INVENTION

The apparatus of the present invention solves problems which are now present in the playing of stringed instruments since with its construction and the elements which form the apparatus, it is possible to achieve any touch that corresponds to a musical harmony merely by pressing a button with a finger, without having to place several fingers in a difficult position and without having to press the strings with such force that at times will cause callouses to appear.

It is an object of the invention to transmit the pressure from a single finger to several predetermined strings for the particular harmony desired.

It is a further object of this invention to transmit the pressure of a single finger by means of several cables to a number of strings.

It is a further object of the present invention to achieve the transmission of the finger pressure through hydraulic or pneumatic means utilizing bellows and connecting conduits.

BRIEF DESCRIPTION OF THE DRAWINGS

The above and other objects and advantages of the invention will become apparent upon full consideration of the following detailed description and accompanying drawings in which.

DESCRIPTION OF THE PREFERRED EMBODIMENTS

Figures 1, 2:
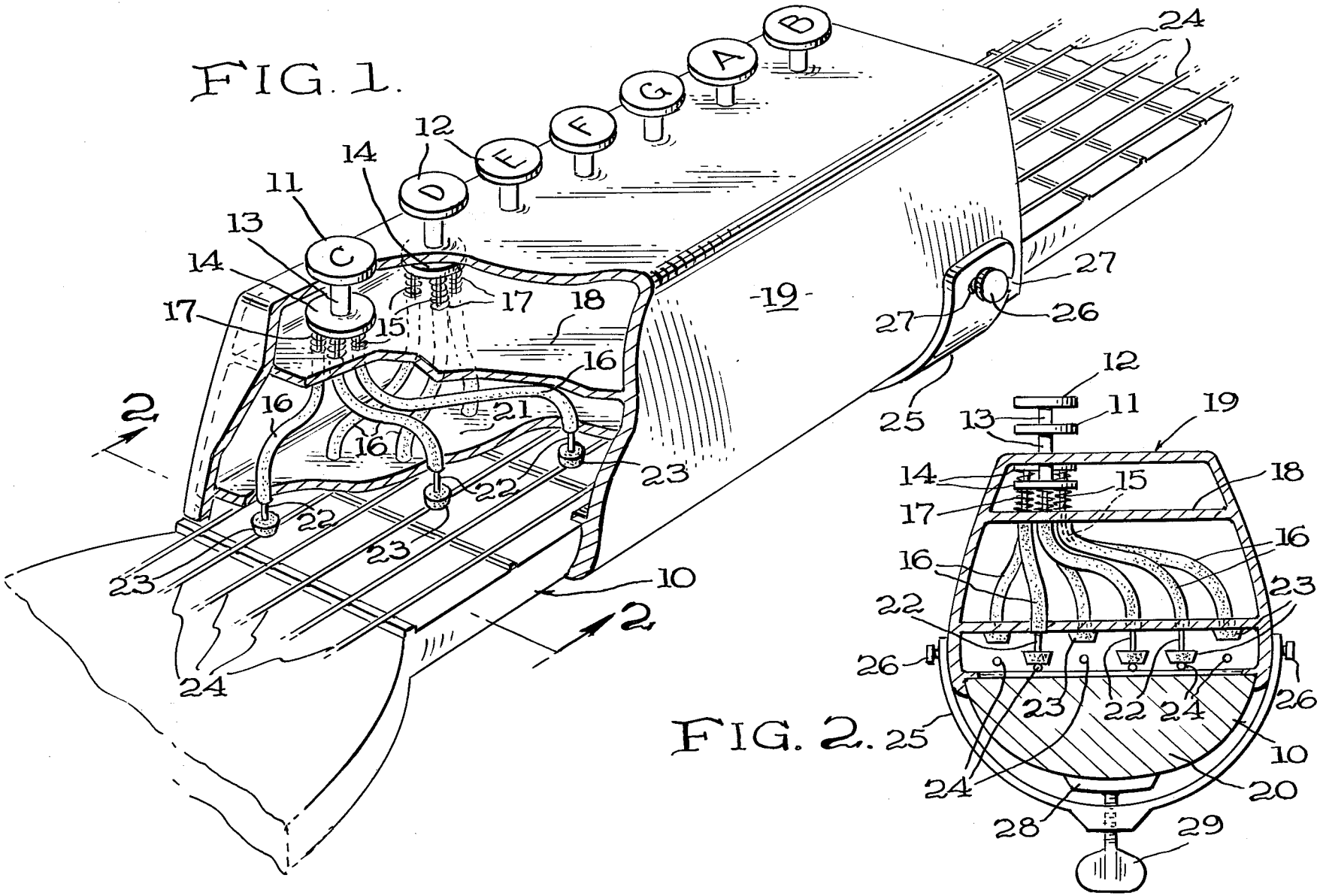
FIG. 1 illustrates with a partially broken-away perspective view the device of the present invention mounted on the neck of an instrument such as a guitar.
FIG. 2 is a section view transversely of the apparatus of FIG. 1 and along line 2—2 of FIG. 1.

Referring first to FIGS. 1 and 2, there is shown the neck 10 of a stringed instrument that may be the type such as a guitar with six strings 24.

In the said figures, a button 11 is marked with the letter C that corresponds as is known by those who are familiar with music, to the note Do; the button 12 being marked with the letter D which corresponds to the musical note Re and other buttons shown thereon corresponding to the musical notes E, F, G, A, B marked thereon. In the figures, button 11 mounted on rigid shaft 13 is shown in the pressed down position as caused by a finger of the musician which presses against disk 14 mounted on shaft 13 and thereby in turn causing disk 14 to press on and compress springs 17 mounted on the top of flexible cables 15 which pass through sleeves 16 and upper deck 18 in cover 19 of the present apparatus. The neck 10 of the instrument which is shown as a sectioned portion 20 in FIG. 2 has a lower deck 21 inside cover 19 against which the sleeves 16 press and through which the flexible cables have their lower ends 22 extending. On the lower ends 22 of the flexible cables there are plugs or legs 23 of rubber or similar material which press against strings 24 when these plugs 23 are in lowered position as shown in the case of three of them in FIGS. 1 and 2 which are seen pressing against the strings 24 specifically the second, fourth and fifth strings from the left so as to produce chord C.

Upon release of the button 11, the button will automatically return to the raised or at rest position such as is illustrated in the case of button 12. Button 11 will raise itself due to the release of compression applied to springs 17 thereby raising disk 14 and exerting a pull through the top ends 15 of the flexible cables attached to disk 14 and transmitting this motion to the lower ends 22 of the flexible cable and in turn raising plugs 23 off of strings 24.

The cover 19 is attached to neck 10 or 20 by means of bolts 26 extending from opposite sides of cover 19 held in slots 27 of fastening arms 25 by the opposing action from screw 29 against a rubber pad 28 between neck 20 and fastening arms 25 arched below neck 20. Neck 20 is compressed between lower depending edges of cover 19 and pad 28.

Figures 3, 4:
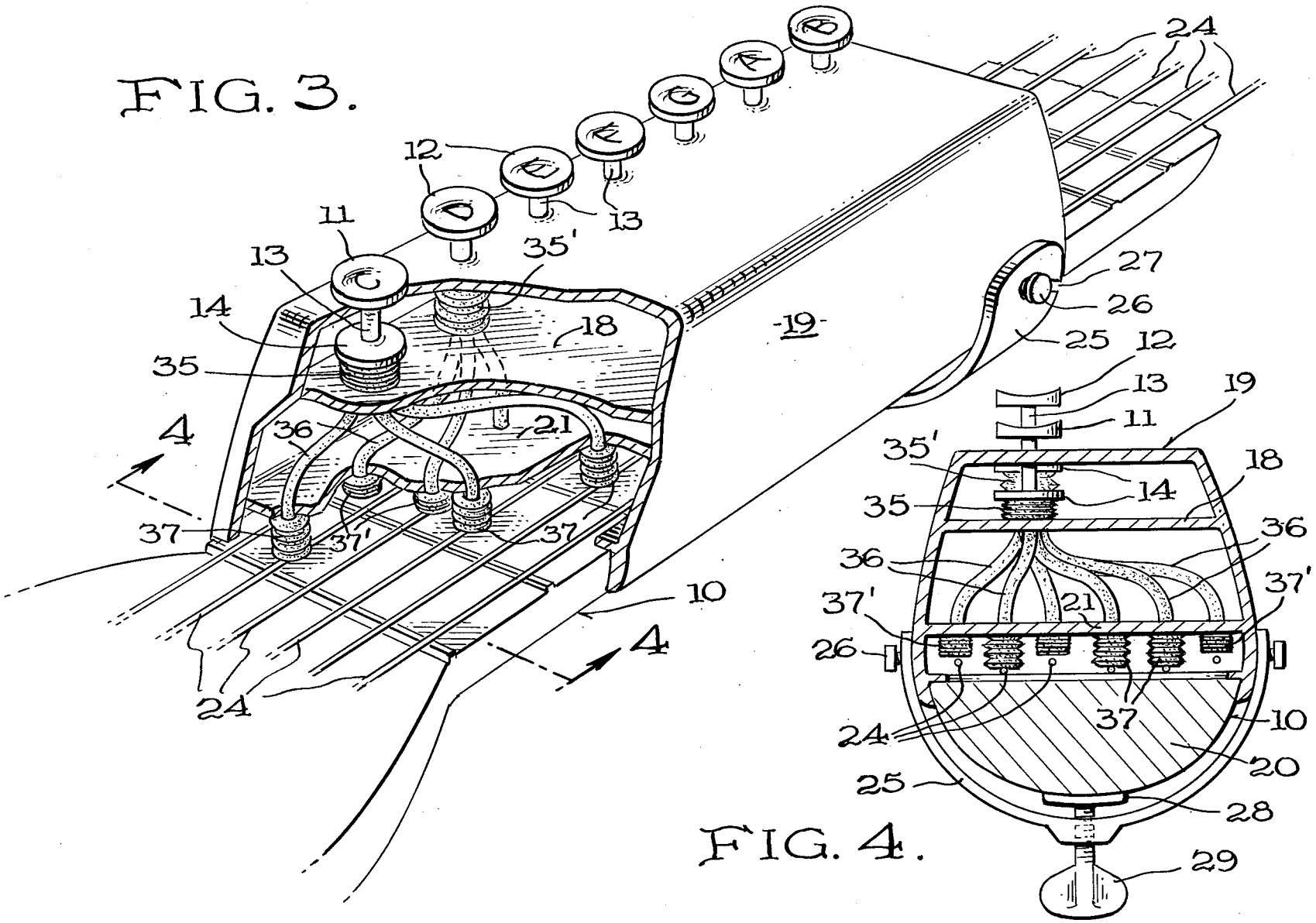
FIG. 3 illustrates with a partially broken-away perspective view another embodiment of the device of the present invention also mounted on the neck of an instrument such as a guitar.
FIG. 4 illustrates a section view along line 4—4 of the embodiment of FIG. 3.

In the embodiment shown in FIGS. 3 and 4 similar parts are designated by similar numerals as in the case of neck 10 of the stringed instrument shown in FIG. 4 as cross-section 20 with strings 24 and the cover 19 of the apparatus of the present invention held to neck 10 or 20 by means of fastening arms 25 connected to casing 19 by means of bolts 26 on opposite sides of casing 19 held in slots 27 on fastening arms 25. Again button 11 is shown in a pressed-down position designated for the playing of the chord C.

Upon applying pressure to button 11, the rigid shaft 13 moves downward and moves disk 14 attached thereto downward so as to press bellows 35 against the action of a spring (not shown) inside said bellows 35. The spring therein and bellows 35 move from the position shown for bellows 35′ to the position of bellows 35 and are compressed by disk 14 against upper deck 18 to which it is also fixed. The pressure of a fluid, either a gas or a liquid, is transmitted either pneumatically or hydrostatically, respectively, through conduits 36 to lower bellows 37 which are smaller than bellows 35 thus moving bellows 37 to collectively accommodate the volume of fluid forced from bellows 35. In the case of chord C, there are three lower bellows 37 connected through three individual conduits 36 to the single bellows 35. These three bellows 37 are connected to lower deck 21 as is the case with all other lower bellows such as bellows 37′ shown compressed or at rest condition. Also bellows 37 connected for operation by button C are placed so as to make contact with those of strings 24 in the second, fourth and fifth positions from the left.

When pressure on button 11 is released and is returned to the rest position shown by button 12, the disk 14 is raised through the action of springs internal to bellows 35 so as to return the bellows to the position shown by bellows 35'. Although the spring action is exerted against upper deck 18, the hermetic sealing of bellows 35 is made through conduits 36 and through deck 21 to bellows 37,37' with the reaction of the lower bellows 37,37' being applied against lower deck 21 and thereby causing them to contact strings 24 when in the extended position depicted by bellows 37. The return of bellows 35 to the extended position denoted by 35' removes the fluid from bellows 37 thereby returning them to the compressed position shown by bellows 37' and in turn releases the pressure from strings 24. Other buttons may then be pressed down depending upon the harmony or chord on the musical scale to be produced.

It is apparent that such a device of the present invention facilitates the learning and playing of a musical stringed instrument, for example, such as the guitar.

It will be obvious to those skilled in the art that various changes may be made without departing from the scope of the invention and the invention is not to be considered limited to what is shown in the drawings and described in the specification.

What is claimed is:

1. Apparatus for use with a stringed instrument comprising a frame supported on the stringed instrument;

means to support said frame on the stringed instrument including means to adjust the compression of said frame against the stringed instrument;

said frame having upper, middle, and lower surfaces supported over a stringed portion of the stringed instrument;

a plurality of pushbutton means each adapted to receive the pressure applied to the stringed instrument by a single finger and designating a chord to be played, said pushbutton means positioned by said upper surface, and said middle surface in opposition to the force on said pushbutton means applied by the finger;

a plurality of hermetically sealed closed systems supported by said frame, each of said hermetically sealed systems including a first bellows connected to each of said pushbutton means having one end attached for movement with said pushbutton means, a plurality of second bellows each smaller than said first bellows and formed to be in a contracted state when at rest position, and conduit means for fluid pressure transmission connecting each of said second bellows to said first bellows;

said lower surface of said frame supporting said second bellows over the strings of the stringed instrument positioned so that each of said second bellows presses against a string when said second bellows is in an expanded state;

and spring means to hold said first bellows in an expanded state in its rest position and oppose a compressing force from said pushbutton means.

2. Apparatus in accordance with claim 1, further characterized by said conduit means being of flexible material.

3. Apparatus in accordance with claim 1, further characterized by said second bellows being of relatively soft rubber-like type of material.

4. Apparatus in accordance with claim 1, further characterized by said second bellows having an end opposite the end contacting the string of the stringed instrument pressed against said lower surface at least when said second bellows is in an extended position.

5. Apparatus in accordance with claim 1, further characterized by fluid in said conduit means being a gas.

6. Apparatus in accordance with claim 1, further characterized by fluid in said conduit means being a liquid.

* * * * *